US010895431B1

(12) United States Patent
Major

(10) Patent No.: US 10,895,431 B1
(45) Date of Patent: Jan. 19, 2021

(54) ARCHERY RELEASE WITH UNIFIED THUMB TRIGGER ADJUSTMENT

(71) Applicant: BERRY MTN., INC., Liverpool, PA (US)

(72) Inventor: Jarrod Burk Major, Liverpool, PA (US)

(73) Assignee: Berry Mtn., Inc., Liverpool, PA (US)

( * ) Notice: Subject to any disclaimer, the term of this patent is extended or adjusted under 35 U.S.C. 154(b) by 0 days.

(21) Appl. No.: 16/858,787

(22) Filed: Apr. 27, 2020

Related U.S. Application Data

(60) Provisional application No. 62/838,352, filed on Apr. 25, 2019.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS

| | | | | |
|---|---|---|---|---|
| 6,205,991 | B1 * | 3/2001 | Summers | F41B 5/1469 124/35.2 |
| 6,651,642 | B1 * | 11/2003 | Powers | F41B 5/1469 124/31 |
| 7,581,536 | B2 * | 9/2009 | Porter | F41B 5/1469 124/35.2 |
| 7,926,475 | B2 * | 4/2011 | Jones | F41B 5/1469 124/35.2 |
| 10,281,231 | B2 * | 5/2019 | Springer | F41B 5/1469 |

* cited by examiner

*Primary Examiner* — John A Ricci
(74) *Attorney, Agent, or Firm* — Hooker & Habib, P.C.

(57) ABSTRACT

A thumb trigger-type archery release includes a trigger that is configured to be pressed by the thumb of an archer to actuate the archery release. The position of the trigger relative to the body of the archery release can be adjusted by the archer via a thumb trigger adjustment mechanism that is part of the archery release. The thumb trigger adjustment mechanism enables fast and convenient positioning of the trigger by loosening and tightening only one fastening member.

13 Claims, 6 Drawing Sheets

ARCHERY RELEASE WITH UNIFIED THUMB TRIGGER ADJUSTMENT

RELATED APPLICATION

This application claims the benefit of and priority to U.S. Patent Application Ser. No. 62/838,352 "Archery Release with Unified Thumb Trigger Adjustment" filed Apr. 25, 2020, which priority application is incorporated by reference as if fully set forth herein.

FIELD OF THE DISCLOSURE

The disclosure relates generally to an archery release used for releasing an arrow from a bowstring, and in particular to an thumb trigger-type archery release with an adjustable trigger position.

BACKGROUND OF THE DISCLOSURE

Archery releases hold a bowstring while an archer is pulling on the release to draw the bowstring. The archery release enables the archer to smoothly and consistently draw back the bowstring and release the bowstring for consistent and repeatable arrow flight.

A trigger-type archery release includes a trigger mechanism having an exposed trigger that typically actuate a hook or jaws operably connected to the trigger mechanism. The archer engages the trigger with a finger of the hand holding the archery release to disengage the bowstring.

A thumb trigger-type archery release includes a body, an exposed thumb trigger spaced from the body, and a release mechanism operatively connecting the thumb trigger to the hook or jaws.

Thumb trigger-type archery releases typically include a thumb trigger adjustment mechanism that enables an archer to adjust the position of the thumb trigger. A thumb trigger adjustment mechanism incorporates multiple parts and multiple screws and set screws. These multiple parts and screws address one adjustment of the thumb trigger at a time: adjust the distance of the thumb trigger from the body, adjust the angle/sweep of the thumb trigger, adjust the rotation or angular position of the thumb trigger, and the like.

It is desirable to have a thumb trigger adjustment mechanism for a thumb trigger-type archery release that is more convenient, simplifies the adjustment process, and is easier for the archer to use.

SUMMARY OF THE DISCLOSURE

Disclosed is a thumb trigger adjustment mechanism for a thumb trigger-type archery release that is a unified thumb trigger adjustment mechanism. The disclosed thumb trigger adjustment mechanism simplifies the process of adjusting the thumb trigger on a handheld archery release and is easier and more convenient for the archer to use.

The disclosed thumb trigger adjustment mechanism allows for simultaneous adjustments of the thumb trigger at the same time. The disclosed thumb trigger adjustment mechanism has only one screw that enables multiple adjustments at once. The archer will position the thumb trigger at the selected length, angle and rotation and then tighten only the one screw. This one screw grips a rod or pin that holds the thumb trigger in a way that fixes the thumb trigger to effectuate the multiple adjustments at once. The disclosed thumb trigger adjustment mechanism is also ambidextrous for use by either right-handed or left-handed archers.

The one screw of the disclosed thumb trigger adjustment mechanism, when tightened, draws the rod against the trigger body gripping the rod that holds the thumb trigger. The rod in variant embodiments may be a knurled rod that is made of a harder material than the surrounding material so when tightened down the knurls will dig-in and lock the position of the rod.

The disclosed thumb trigger adjustment mechanism simplifies the process of positioning the thumb trigger for the archer and also greatly reduces the parts typically needed for providing thumb trigger adjustments, simplifying manufacture and reducing cost.

Other objects and features of the disclosure will become apparent as the description proceeds, especially when taken in conjunction with the accompanying drawing sheets illustrating one or more illustrative embodiments.

DETAILED DESCRIPTION

Figure 1:
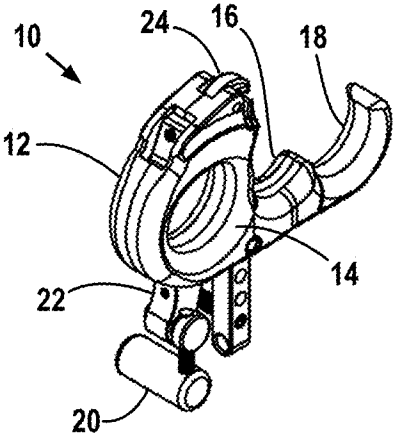
FIG. 1 is a perspective view of a thumb trigger-type archery release employing the disclosed thumb trigger adjustment mechanism.
Figure 2:
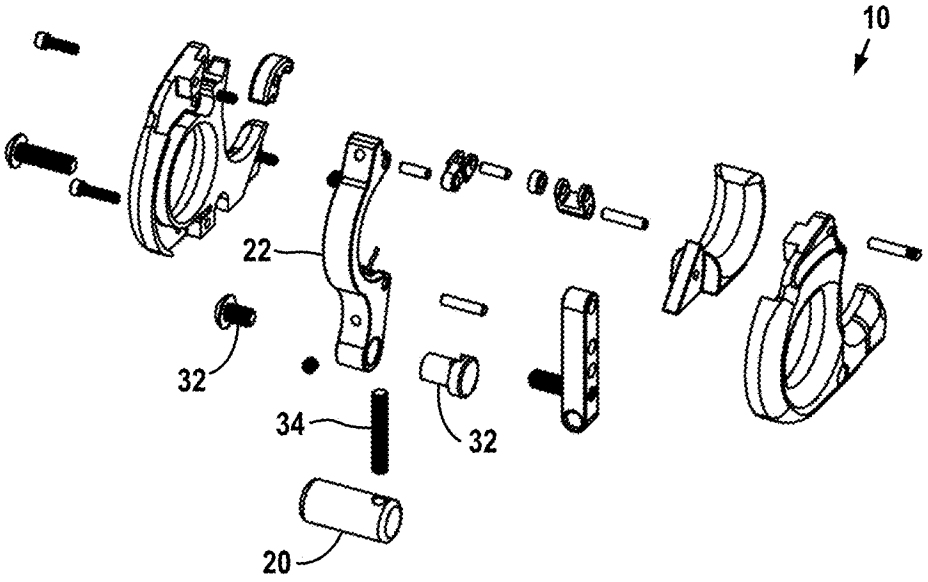
FIG. 2 is an exploded view of the archery release shown in FIG. 1.
Figure 3:
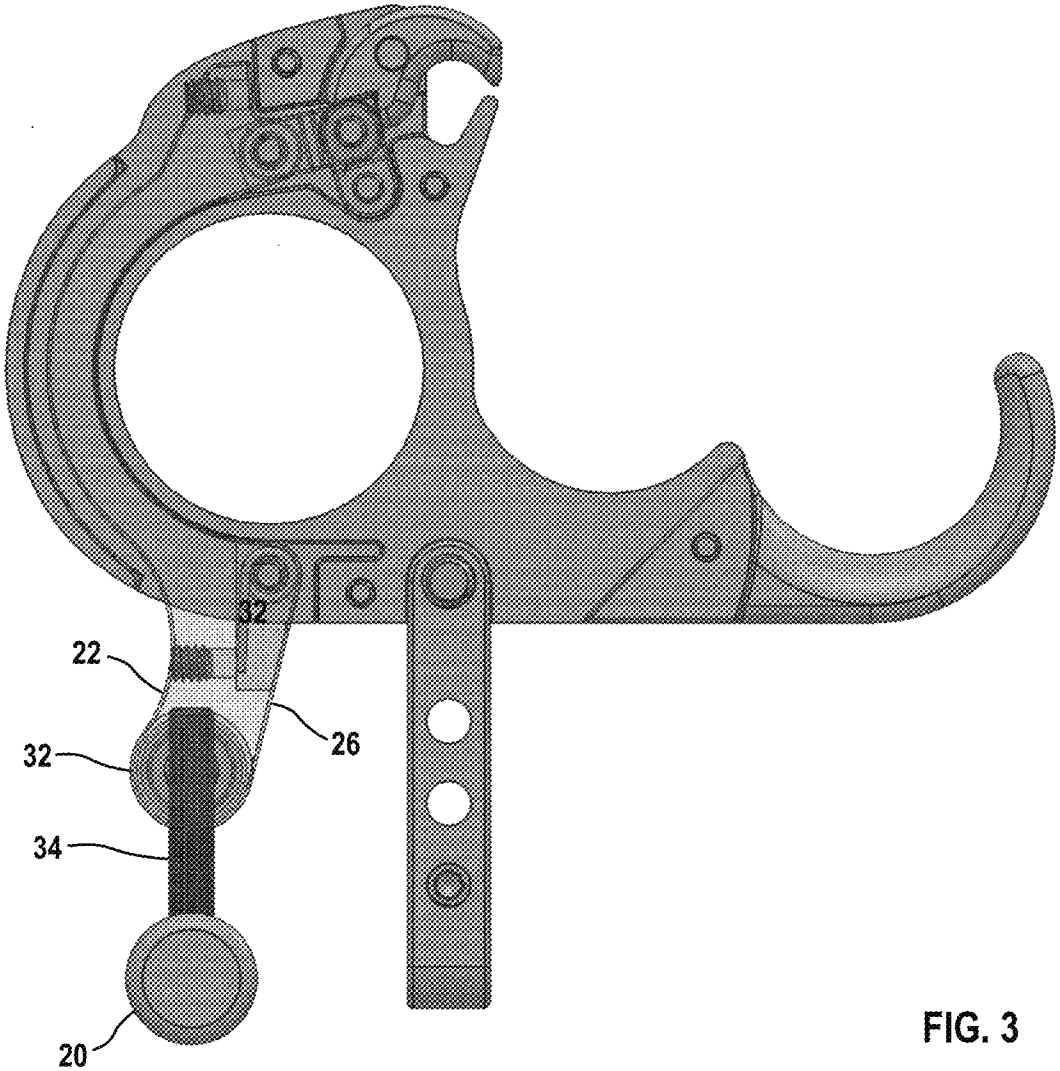
FIG. 3 is a front sectional view of the archery release shown in FIG. 1.

FIGS. 1-3 illustrates a thumb trigger-type archery release 10 that employs the thumb trigger adjustment mechanism in accordance with this disclosure. The archery release includes a body 12 configured as a hand grip for holding the archery release defining a first finger grip 14, second finger grip 16, and third finger grip 18. The first finger grip is formed as a through-hole extending through the body. The other finger grips are concave shaped with crests separating adjacent finger grips. A thumb trigger 20 is spaced from the body and is attached to a trigger arm 22.

Figure 4:
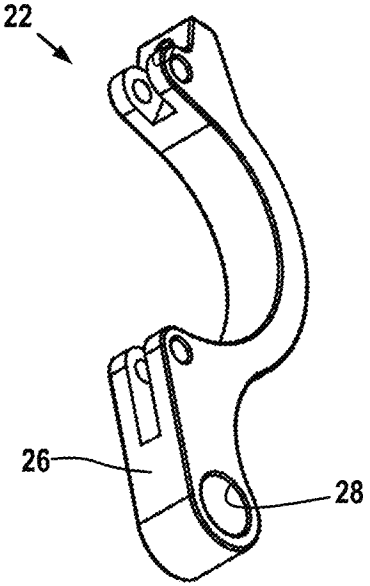
FIGS. 4-6 are views of the trigger arm of the archery release shown in FIG. 1.
Figure 5:
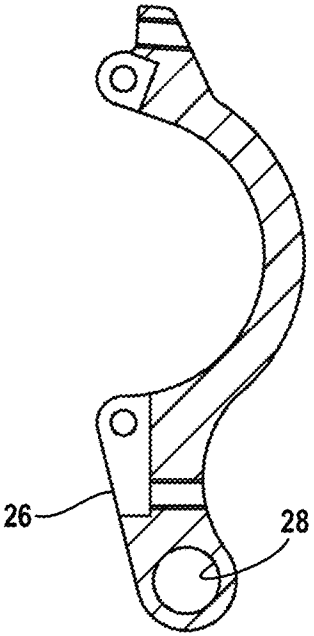
Figure 6:
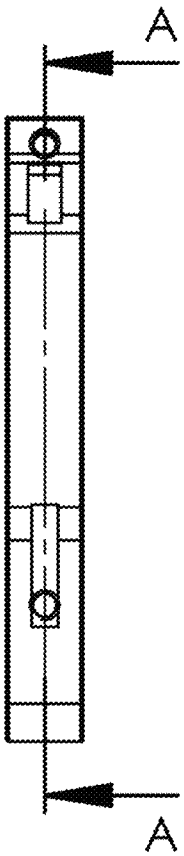
Figure 7:
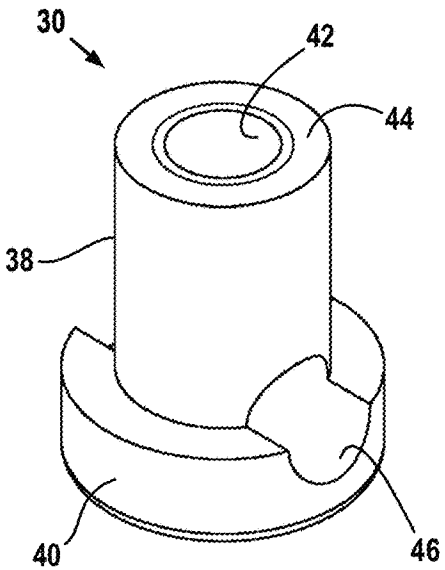
FIGS. 7-9 are perspective, top, and side views respectively of the thumb post adapter shown in FIG. 2.
Figure 8:
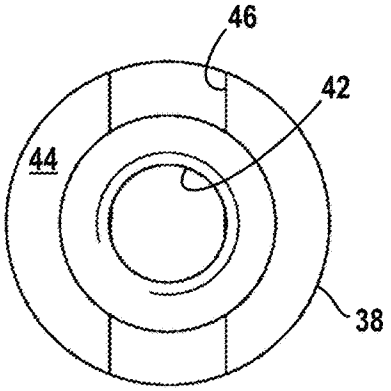
Figure 10:
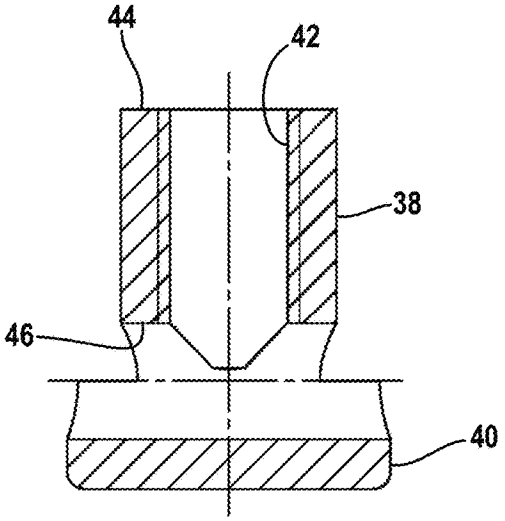
FIG. 10 is a sectional view of the thumb post adapter taken along line A-A of FIG. 11.
Figure 9:
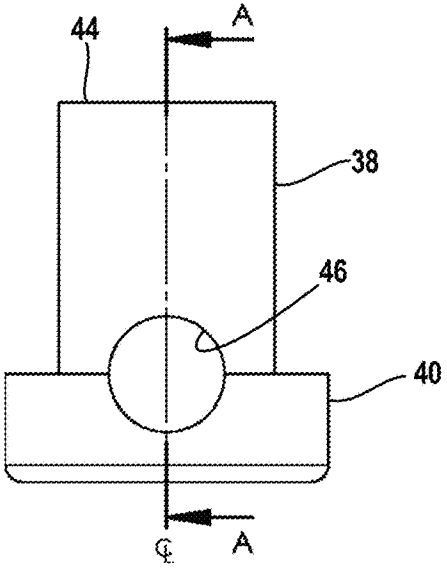

The trigger arm 22 forms part of a release mechanism that operatively connects the trigger 20 to a movable hook 24. The trigger arm 22 shown separately in FIGS. 4-6 is disposed in the body 12 and extends partially around the first finger grip. The lower end of the trigger arm 22 extends out of the body 12 to a free end portion 26 spaced from the body. The trigger arm 22 is movable relative to the body 12 in response to the archer pressing the trigger 20 to displace the hook or jaw(s) to release a bowstring held in the archery release.

Figure 11:
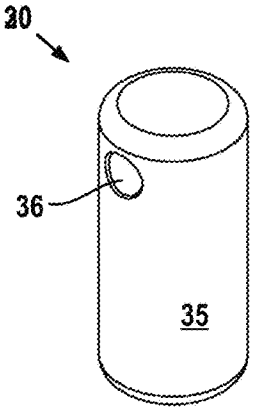
FIGS. 11-14 are views of the archery release trigger shown in FIGS. 1 and 2.
Figure 12:
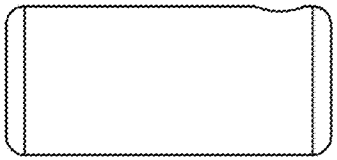
Figure 16:
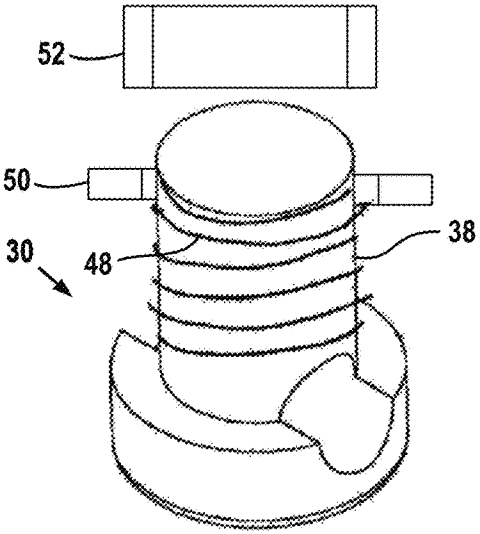
FIG. 16 illustrates a second embodiment thumb post adapter.
Figure 13:
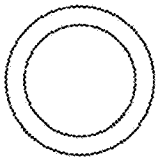
Figure 14:
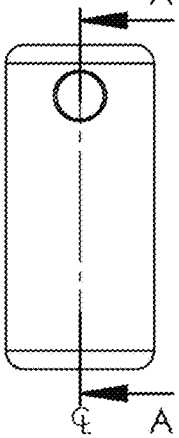

The trigger 20 is connected to the trigger arm end portion 26. by a thumb trigger adjustment mechanism. The thumb trigger adjustment mechanism includes a through-hole 28 formed in the lower free end portion of the trigger arm 22 as seen in FIG. 2 and FIG. 5, a thumb post adapter 30, a set screw 32, a knurled rod or pin 34, and a blind hole 36 formed in the trigger 20, see FIGS. 2, 3, and 11.

The thumb post adapter 30 is shown in FIGS. 7-10. The thumb post adapter includes a central tubular portion 38 extending upwardly from an enlarged radius collar 40 as viewed in FIG. 7. The tubular portion 38 surrounds an internally threaded bore 42 open at the upper end 44 of the tubular portion 38 opposite the collar 40. A radial through hole 46 extends through thumb post adapter 30, the centerline of the through hole 46 located in the plane defined by the meeting of the collar 40 and the central tubular portion 38.

The central tubular portion 38 of the thumb post adapter 30 is received into one side of the trigger arm through hole 28 and extends through the through hole 28 to locate the open end 44 of the thumb post flush or just short of flush with the other side of the trigger arm through hole 28. The set screw 32 is received from the other side of the trigger arm through hole 28 and threadingly engages and is thread into the threaded bore 42 of the thumb post adapter 30 and clamps and mounts the thumb post adapter to the trigger arm end portion 26.

The knurled rod 34 extends through and is closely received in the radial through hole 46 of the thumb post adapter and extends away from the thumb post adapter to the trigger 20. The rod 34 is used to locate and orient the trigger 20 with respect the trigger arm 22 as will be discussed later below.

The trigger 20 is shown separately in FIGS. 11-14. The trigger is formed as a cylindrical pin 35 that includes a blind bore 36 that receives the free end of the rod 34 to mount the trigger 20 to the end of the rod 34. The trigger pin 35 is normally spaced away from the thumb post adapter 30 and away from the trigger arm 22 as can best be seen in FIG. 3.

Figure 17:
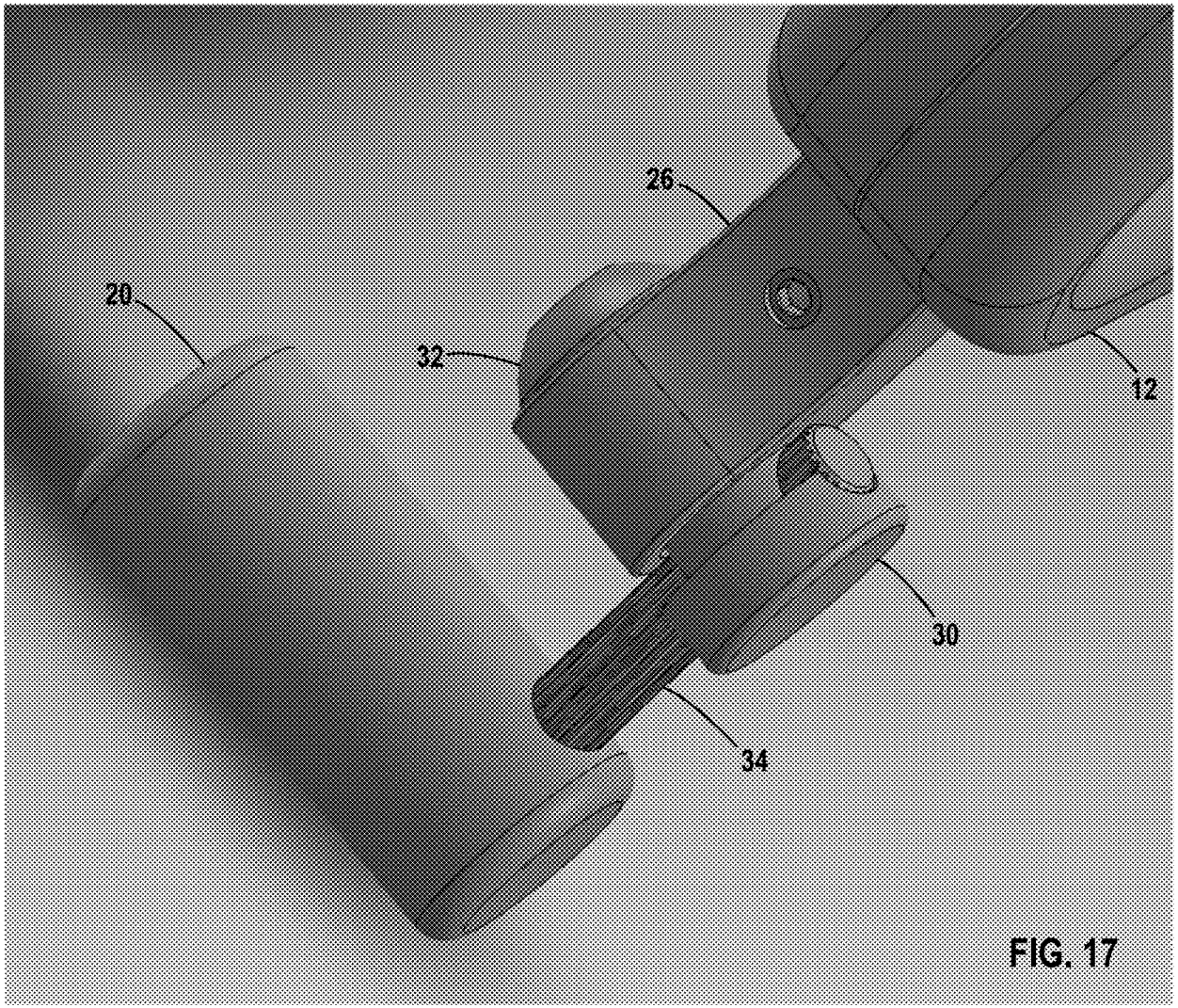
FIG. 17 is a view of the trigger fastened to the trigger arm of the archery release.

To fix the position of the trigger 20 relative to the trigger arm 22, the set screw 32 is screwed into the thumb post adapter 30 to tightly and releasably clamp the thumb post adapter 30 against the trigger arm 22. The rod 34 is sandwiched between the collar 40 and the trigger arm 22 and is pressed against the trigger arm 22. Static friction, generated by the normal force applied to the rod 34 against the trigger arm 22 and the thumb post adapter 30, resists translation and rotation of the rod 34 in the radial through hole 46 of the thumb post adapter 30 thereby fixing the distance from and the relative angular orientation of the trigger 20 to the thumb post adapter 30. Friction also resists rotation of the thumb post adapter 30 in the trigger arm through hole 28, thereby fixing the angular position of the trigger 20 about the center line of the trigger arm through hole 28. The trigger 20 is effectively fixed in position relative to the trigger arm. See FIG. 17.

To adjust the position of the trigger 20 relative to the trigger arm 22, the set screw 32 is loosened sufficiently to allow the rod 34 to rotate and translate in the radial though hole 46 of the thumb post adapter 39. This enables adjusting the distance of the trigger 20 from the thumb post adapter 30 and the relative angular position of the trigger 30 about the longitudinal axis of the rod 34. Loosening the set screw 32 also enables the thumb post adapter 30 to rotate in the trigger arm through hole 28 for positioning the angular position of the trigger 20 about the center line of the trigger arm through hole 28.

Once the thumb 20 is positioned by the archer as desired with respect to spacing from the thumb post adapter 30 and angular orientations about the rod 34 and the trigger arm through hole 28, the set screw 32 is re-tightened to fix this position of the trigger 20 with respect to the trigger arm 22.

Figure 15:
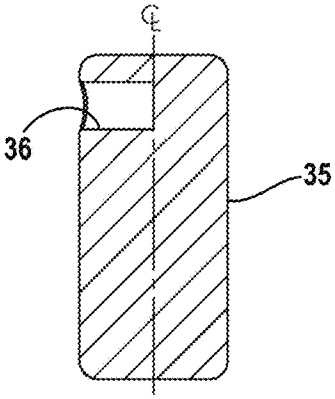
FIG. 15 is a sectional view of the trigger taken along line A-A of FIG. 14.

The illustrated thumb trigger adjustment mechanism utilizes a set screw and internally threaded thumb post adapter to releasably clamp the thumb post adapter 30 against the free arm 22. Alternatively, the tubular portion 38 of the thumb post adapter 30 can be replaced with a solid cylindrical portion 38 as illustrated in FIG. 15 having external threads 48 instead of internal threads. The free end of the cylindrical portion 38 would extend beyond the trigger arm 22 when placed in the trigger arm 28 to receive a nut 50 or internally-threaded cap nut or bolt 52 threaded onto the thumb post adapter 30 to releasably clamp the thumb post adapter 30 against the trigger arm 22.

The disclosed thumb trigger adjustment mechanism enables fast and convenient positioning of the trigger by loosening and tightening only one fastening member such as the set screw 32 or the nut 50.

While this disclosure includes one or more illustrative embodiments described in detail, it is understood that the one or more embodiments are each capable of modification and that the scope of this disclosure is not limited to the precise details set forth herein but include such modifications that would be obvious to a person of ordinary skill in the relevant art including (but not limited to) changes in material selection, size, operating ranges, environment of use, as well as such changes and alterations that fall within the purview of the following claims.

What is claimed is:

1. An archery release comprising:

a trigger mechanism comprising an exposed trigger, a hook or jaws, the hook or jaws movable between opened and closed positions, a trigger arm operatively connected to the hook or jaws to move the hook or jaws between opened and closed positions, and a trigger adjustment mechanism attaching the trigger to the trigger arm;

the trigger adjustment mechanism comprising an opening in the trigger arm, an adapter, a rod, and a fastener;

the adapter comprising a cylindrical portion extending along a first axis, an enlarged collar attached to the cylindrical portion, and a through-hole extending through the adapter adjacent to the collar, the through-hole extending along a second axis transverse to the first axis, the cylindrical portion being sized to be receivable into the trigger arm opening and configured to be rotatable about the first axis relative to the trigger arm when in the trigger arm opening, the collar being sized not to be received into the trigger arm opening;

the rod being sized to be insertable into the adapter through-hole and being translatable and rotatable while extending through the adapter through-hole when the adapter is unstressed;

the fastener being configured to be attachable to the adapter when the cylindrical portion of the adapter is received in the trigger arm opening wherein the fastener and the adapter can be selectively placed in either a tightened state and a loosened state;

the rod in the adapter through-hole and extending away from the adapter to a free end portion, the trigger attached to the free end portion;

the cylindrical portion of the adapter being received in the trigger arm opening, the fastener attached to the adapter, when the fastener and the adapter are in the tightened state the fastener urges the adapter collar towards the trigger arm and thereby sandwiches the rod between the trigger arm and the adapter collar with sufficient pressure to resist relative movement of the rod with the adapter and to resist relative rotation of the adapter with respect to the trigger arm whereby the trigger is fixedly positioned with respect to the trigger arm, and when the fastener and the adapter are in the loosened state the adapter is unstressed and the rod can translate and rotate with respect to the adapter and the adapter can rotate with respect to the trigger arm whereby the position and angular orientations of the trigger with respect to the trigger arm can be adjusted by an archer.

2. The archery release of claim 1 wherein the cylindrical portion of the adapter is an internally threaded tubular portion.

3. The archery release of claim 2 wherein the fastener is a set screw threadably received into the adapter tubular portion, the adapter tubular portion is received in one end of the trigger arm opening, and the screw is received into an opposite other end of the trigger arm opening.

4. The archery release of claim 1 wherein the trigger arm comprises a curved portion having a radius and a radial portion extending radially from the curved portion, the trigger arm opening disposed in the radial portion.

5. The archery release of claim 1 wherein the cylindrical portion of the adapter is externally threaded.

6. The archery release of claim 5 wherein the fastener has internal threads threadably screwed onto the adapter cylindrical portion.

7. The archery release of claim 6 wherein a portion the adapter tubular portion extends out of the trigger arm opening, and the fastener is threaded onto the portion of the adapter tubular portion.

8. The archery release of claim 7 wherein the fastener is a cap screw or an internally threaded bolt.

9. The archery release of claim 1 wherein the archery release is a thumb-type trigger release and the trigger is a thumb trigger configured to be pressed by an archer's thumb.

10. The archery release of claim 1 wherein the archery release comprises a finger grip comprising an index finger portion being configured to receive an index finger of an archer.

11. The archery release of claim 1 wherein the rod is a knurled rod.

12. The archery release of claim 1 wherein the collar defines a plane disposed where the cylindrical portion meets the collar, the second axis of the adapter through-hole being disposed in the plane.

13. The archery release of claim 1 wherein the rod is received in a blind hole disposed in the trigger.

* * * * *